US008070248B2

(12) United States Patent
Ogama

(10) Patent No.: US 8,070,248 B2
(45) Date of Patent: Dec. 6, 2011

(54) IMAGE FORMING APPARATUS AND CONTROL METHOD OF THE SAME

(75) Inventor: Takeo Ogama, Hachioji (JP)

(73) Assignees: Ortek Corporation, Tokyo (JP); Riso Kagaku Corporation, Tokyo (JP)

( * ) Notice: Subject to any disclaimer, the term of this patent is extended or adjusted under 35 U.S.C. 154(b) by 370 days.

(21) Appl. No.: 12/358,461

(22) Filed: Jan. 23, 2009

(65) Prior Publication Data

US 2009/0195588 A1 Aug. 6, 2009

(30) Foreign Application Priority Data

Jan. 31, 2008 (JP) ..... 2008-021823

(51) Int. Cl.

| | |
|---|---|
| ***B41J 29/38*** | (2006.01) |
| ***B41J 29/393*** | (2006.01) |
| ***B41J 2/05*** | (2006.01) |
| ***B41J 2/18*** | (2006.01) |

(52) U.S. Cl. ..... 347/14; 347/5; 347/6; 347/9; 347/17; 347/18; 347/19; 347/54; 347/56; 347/57; 347/66; 347/67; 347/84; 347/85; 347/89

(58) Field of Classification Search ..... 347/14, 347/17, 19, 66, 89
See application file for complete search history.

(56) References Cited

U.S. PATENT DOCUMENTS 5,467,113 A * 11/1995 Ishinaga et al. ..... 347/17
6,428,156 B1 * 8/2002 Waller et al. ..... 347/89

FOREIGN PATENT DOCUMENTS

JP 2006-199021 A 8/2006

* cited by examiner

*Primary Examiner* — Ryan Lepisto
(74) *Attorney, Agent, or Firm* — Holtz, Holtz, Goodman & Chick, PC

(57) ABSTRACT

An image forming apparatus performs an image forming operation by driving a ejecting element of a recording head with an ink ejecting drive voltage for ejecting ink, detects a temperature of ink to be flown into the recording head and a temperature of ink to be discharged respectively with a first temperature detection section and a second temperature detection section, and corrects the ink ejecting drive voltage on the basis of a temperature of ink being heat-transferred with the ejecting element, which is estimated with a predetermined conversion formula on the basis of the detected ink temperatures, for controlling an ink amount to be ejected.

10 Claims, 6 Drawing Sheets

IMAGE FORMING APPARATUS AND CONTROL METHOD OF THE SAME

CROSS-REFERENCE TO RELATED APPLICATIONS

This application is based upon and claims the benefit of priority from prior Japanese Patent Application No. 2008-021823, filed Jan. 31, 2008, the entire contents of which are incorporated herein by reference.

BACKGROUND OF THE INVENTION

1. Field of the Invention

The present invention relates to an image forming apparatus which ejects ink for recording an image on a recording medium and a control method of the same.

2. Description of the Related Art

Generally, image forming apparatuses including a recording head that drives an actuator comprised of a piezoelectric element or a heater element for ejecting ink, what are called ink-jet printers are known. When an actuator is driven, heat is generated by both of the actuator itself and a drive section (driving IC) of the actuator. In recent image forming apparatuses, there is a trend wherein a heat generation amount increases with an increase in number of nozzles due to speed up of recording rate and an adoption of a line head. In order to suppress heating of the recording head arising from the heat generation, for example, Jpn. Pat. Appln. KOKAI Publication No. 2006-199021 discloses an art wherein a discharge path (ink return path) is provided to an ink supply path including a recording head for circulating ink. This art enables heat to be removed from the recording head by the circulation of ink, and thereby suppressing heating of the recording head.

Fluids, such as ink has a characteristic of decreasing in viscosity as its temperature rises. In image forming apparatuses too, viscosity of ink decreases as ink temperature rises, regardless of types of ink used. Because of the above characteristic, amounts of ink to be discharged (drop amount) differ between a case where ink temperature is high and a case where ink temperature is low, even if the recording head is driven with the same drive voltage in the both cases. More specifically, an amount of ink to be discharged is increased when ink temperature is high. Therefore, ink temperature inside a recording head rises when the driven recording head is heated, and quality of images to be formed (or printing quality) may not be kept constant when the recording head is driven with the same drive voltage as in the case where the ink temperature is low. Under the circumstances, a head drive voltage needs to be corrected. For instance, according to Jpn. Pat. Appln. KOKAI Publication No. 2006-199021, a temperature sensor is provided downstream of a recording head in an ink circulation path for cooling the recording head. The temperature sensor detects ink temperature, and a drive voltage of the recording head is corrected on the basis of a detected value. Furthermore, another temperature sensor is provided upstream of the recording head in the ink circulation path for regulating temperature of ink supplied to the recording head.

Conventional temperature characteristic graphs of FIG. 9 indicate examples wherein temperature of ink downstream of a recording head in an ink circulation path is detected. This figure shows a difference between example A wherein ink temperature is high upstream of the head and example B wherein ink temperature is low upstream of the head. In the graphs, TC indicates ink temperature in a nozzle section when ink temperature upstream of the head is high, and TD indicates ink temperature in the nozzle section when ink temperature upstream of the head is low. It is assumed that the nozzle section exists substantially in the middle of an interval starting from a point when ink flows into the recording head to a point when the ink flows out therefrom.

It cannot be known what degrees the ink temperature was when the ink flew in merely by detecting temperature of ink downstream of the head. In other words, it cannot be known what degrees the temperature of ink rose by going through the head. Surrounding temperature of nozzles ejecting ink of the recording head is reflected in a difference between ink temperature upstream of the head and ink temperature downstream of the head. The surrounding temperature of nozzles ejecting ink of the recording head therefore cannot be known unless the temperature difference is obtained.

Also, as shown in FIG. 9, ink temperatures TC and TD in the nozzle section depend on ink temperature upstream of the head. It is therefore unreasonable to estimate surrounding temperature of nozzles ejecting ink of the recording head and surrounding temperature of nozzles ejecting ink merely from temperature of ink downstream of the head. Correcting a drive voltage of the recording head by using only ink temperature downstream of the head causes a large margin of error between a corrected drive voltage and an appropriate drive voltage.

BRIEF SUMMARY OF THE INVENTION

The object of the present invention is to provide an image forming apparatus and a control method of the same capable of keeping graphic quality constant even under a continuous operation, by detecting temperature of fluid flowing through a recording head for estimating ink temperature in a nozzle section and performing an appropriate correction for a head drive voltage.

According to one embodiment of the present invention, there is provided an image forming apparatus comprising: a recording head on which a plurality of nozzles for ejecting ink are formed; a supply path for supplying fluid to the recording head; a discharge path for ejecting the fluid from the recording head; a first thermistor arranged on the supply path side; a second thermistor arranged on the discharge path side; and a control section for setting an ink ejecting drive voltage for the recording head on the basis of an output from the first thermistor and an output from the second thermistor.

DETAILED DESCRIPTION OF THE INVENTION

Hereinafter, embodiments of the present invention will be explained in detail with reference to the accompanying drawings.

Figure 1:
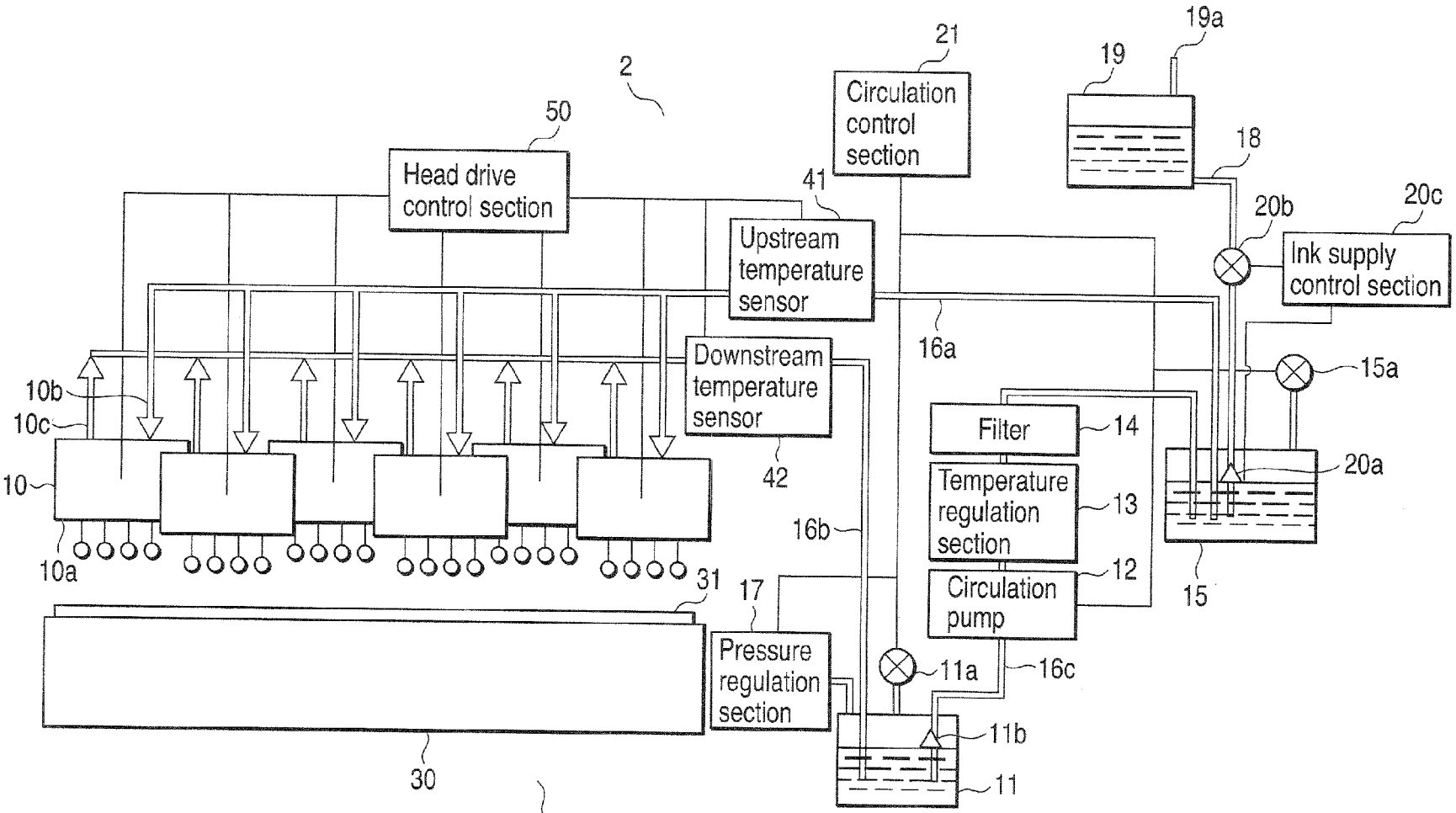
FIG. 1 is a schematic diagram for showing a configuration of an image forming apparatus according to a first embodiment of the present invention.
Figure 2:
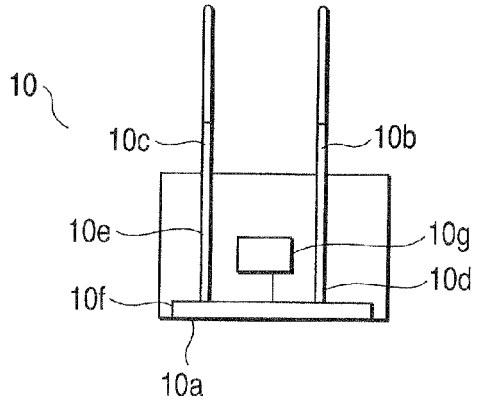
FIG. 2 is a schematic diagram for showing a configuration of a recording head of the first embodiment.

A configuration of an image forming apparatus according to the first embodiment will be explained with reference to FIGS. 1 and 2. FIG. 1 is a schematic diagram showing a configuration of an image forming apparatus of the present embodiment. FIG. 1 indicates a configuration example in which an ink circulation path (channel), which is a gist of the present invention, is shown mainly. Thus, other components such as a control unit for controlling a whole apparatus (e.g., CPU), a monitor, an instruction input section (e.g., key switch), a supply/ejection mechanism for recording media, etc. are omitted in this figure. However, FIG. 1 is provided on the presumption that the image forming apparatus according to the present embodiment includes components included in a standard image forming apparatus.

The image forming apparatus according to the present embodiment is what is called an ink-jet printer, and it comprises a recording head 10 for ejecting ink by an ink-jet method, a carrying mechanism 30 for a recording medium 31, and an ink circulation path 2 including the ink head 10. An upstream ink port 10*b* which serves as a flow inlet of ink and a downstream ink port 10*c* which serves as a eject outlet are provided on the recording head 10.

The ink circulation path 2 comprises an ink supply path (upstream side) for supplying ink from an upstream sub-tank 15 to the upstream ink port 10*b* of the recording head 10, an ink discharge path (downstream side) for ejecting ink not ejected from the recording head 10 from the downstream ink port 10*c* of the recording head 10 to a downstream sub-tank 11, and an ink return path for returning the ink from the downstream sub-tank 11 to the upstream sub-tank 15. In the present embodiment, an ink circulation path is taken as an example for explaining a configuration of the image forming apparatus. However, an ink circulation path does not necessarily have to be provided for circulating ink, as long as the recording head is provided with such an ink supply path wherein ink is supplied to the inside of the recording head and ink not discharged from the recording head is discharged outside of the recording head.

In the ink supply path located on the upstream side of the ink circulation path 2, the upstream sub-tank 15 wherein an ink level (or an arrangement position of the tank) is provided at a position higher than that of a nozzle 10*a* in a direction of gravitational force, a tube 16*a* for connecting the recording head 10 and the upstream sub-tank 15, and an upstream temperature sensor 41 being provided closed to the upstream ink port 10*b* on the tube 16*a* for detecting ink temperature are arranged.

Furthermore, in the ink discharge path located on the downstream side of the ink circulation path 2, a downstream sub-tank 11 wherein an ink level (or an arrangement position of the tank) is provided at a position lower than that of the nozzle 10*a* in the direction of gravitational force, a tube 16*b* for connecting the recording head 10 and the downstream sub-tank 11, a downstream temperature sensor 42 being provided closed to the downstream ink port 10*c* on the tube 16*b* for detecting ink temperature are arranged.

The upstream temperature sensor 41 is provided on the tube 16*a* at a position close to the recording head 10, so that it is able to accurately detect temperature of ink flowing into the recording head. Similarly, the downstream temperature sensor 42 is provided on the tube 16*b* at a position close to the recording head 10, so that it is able to accurately detect temperature of ink discharged from the recording head.

Furthermore, a tube 16*c* for connecting the downstream sub-tank 11 and the upstream sub-tank 15 is provided for constructing the ink return path. This ink return path is provided with a circulation pump 12 for supplying pressure for circulating ink, a temperature regulation section 13 for regulating ink temperature, and a filter 14 for eliminating foreign substances in the circulating ink. With respect to regulation of ink temperature performed by the temperature regulation section 13, a detection value obtained from the upstream temperature sensor 41, which is used for correcting a drive voltage to be explained later, may be used, or another temperature sensor may be provided to the ink supply path.

The upstream sub-tank 15 is provided with an upstream atmosphere open value 15*a*, a liquid level sensor 20*a* arranged inside the tank, an ink bottle 19 connected with a tube 18, a valve 20*b* provided on the tube 18, and an ink supply control section 20*c* for opening and closing the valve 20*b*, all of which are to be explained later. Further, the ink bottle 19 is provided with an atmosphere communicating tube 19*a*.

Also, the downstream sub-tank 11 is provided with a downstream atmosphere open valve 11*a*, a liquid level regulation section 11*b* provided in the tank on an end part of the ink return path, and a pressure regulation section 17 for regulating pressure inside the tank, all of which are to be explained later.

Furthermore, the upstream atmosphere open valve 15*a*, the downstream atmosphere open valve 11*a*, the pressure regulation section 17, and the circulation pump 12 are provided with a circulation control section 21 for controlling the circulation according to a condition of the ink circulation.

Now, the recording head will be explained. FIG. 2 is a diagram schematically showing a configuration of the recording head 10.

The recording head 10 comprises a ejecting element 10*f*, a nozzle 10*a* provided in a part of or close to the ejecting element 10*f*, an upstream ink path 10*d* for supplying ink from the upstream ink port to the ejecting element 10*f*, a downstream ink path 10*e* for guiding the ink from the ejecting element 10*f* to the downstream ink port 10*c*, and a drive IC 10*g* for driving the ejecting element 10*f*. The upstream ink path 10*d* and the ejecting element 10*f* are represented as, for example, an actuator configured with a piezoelectric element. The nozzle 10*a* discharges ink in response to drive of the ejecting element 10*f*. A drive condition of the ejecting element 10*f* is controlled by the head drive control section 50.

The downstream sub-tank 11 is provided with the downstream atmosphere open valve 11*a*. This downstream atmosphere open valve 11*a* is opened when the pressure regulation section 17 releases atmosphere of internal space of the downstream sub-tank 11 for regulating atmospheric pressure thereof. During an image forming operation, the internal space has an atmospheric pressure since the downstream atmosphere open valve 11*a* is opened. The downstream sub-tank 11 can be hermetically sealed by closing the downstream atmosphere open valve 11*a*.

The downstream sub-tank 11 is arranged at a position (height) where the nozzle 10*a* is applied with an appropriate pressure (at which a meniscus is formed) by a water head difference between a liquid level position of the downstream sub-tank 11 and the nozzle 10*a*, when the inside of the tank is kept at atmospheric pressure. When the downstream atmosphere open valve 11*a* hermetically closes the downstream sub-tank 11, the pressure regulation section 17 regulates atmospheric pressure inside the downstream sub-tank 11 in such a manner that the nozzle 10*a* is applied with an appropriate pressure regardless of ink circulation status.

A liquid level regulation section 11*b* regulates amount of ink to be pumped up from the downstream sub-tank 11 to the upstream sub-tank 15. Furthermore, the downstream atmosphere open valve 11*a* is provided with a filter not shown, and this filter prevents external foreign substances from getting into the ink circulation path 2 through the downstream atmosphere open valve 11*a*.

A height of the liquid level inside the upstream sub-tank 15 is detected by a liquid sensor 20*a*. The upstream sub-tank 15 is restocked with ink from the ink bottle 19 as needed for maintaining the height of the liquid level always appropriate, so that a water head difference suitable for performing ink discharge is maintained.

The filter, which is not shown, provided to the upstream atmosphere open valve 15*a* prevents foreign substances from getting into the ink circulation path 2 through the upstream atmosphere open valve 15*a*. A valve 20*b* is provided on the route of the tube 18. This valve 20*b* is closed except for occasions when ink is restocked to the upstream sub-tank 15 from the ink bottle 19. The inside of the ink bottle 19 is kept at atmospheric pressure by the atmosphere communicating tube 19*a* provided on the ink bottle 19.

The circulation control section 21 controls operations of the upstream atmosphere open valve 15*a*, the downstream atmosphere open valve 11*a*, the pressure regulation section 17, and the circulation pump 12 in accordance with ink circulation status. When ink is circulated, the upstream atmosphere open valve 15*a* is opened and the downstream atmosphere open valve 11*a* is closed. The pressure regulation section 17 regulates atmospheric pressure inside the downstream sub-tank 11 so that an ink liquid pressure in the nozzle 10*a* becomes appropriate. When the ink is not circulated, the upstream atmosphere open valve 15*a* is opened and the downstream atmosphere open valve 11*a* is closed. As described above, the ink liquid pressure in the nozzle 10*a* is appropriate at this time. The appropriate pressure here means a pressure at which a meniscus is formed in the nozzle 10*a*. That is to say, a condition in which the ink is able to be discharged.

Next, a process in which the image forming apparatus 1 records an image on the recording medium 31 will be explained.

According to the present embodiment, the recording head 10 has a nozzle line length (a width of an image formed with a length of the plurality of nozzles when they are arranged in a linear shape) shorter than a width of the recording medium 31. A plurality of the recording heads 10, for example, six recording heads 10 are arranged to form a line in a staggered manner in a width direction of the recording medium, such that end parts of the nozzles overlap with each other (refer to FIG. 1). These recording heads 10 form a line for every ink color. That is to say, in an image forming apparatus ejecting four colors of ink, four head lines are provided.

These recording heads 10 are driven on the basis of drive conditions instructed by the head drive control section 50, and discharge ink to the recording medium 31 that is carried at an opposed position 2 mm apart from the nozzles 10*a*. The recording medium 31 is carried by the carrying mechanism 30 in a direction orthogonal to the line formed with the recording heads 10. Each of the recording heads 10 discharges ink on the basis of a discharge signal synchronized with a carrying speed of the recording medium 31, thereby forming an image on the recording medium 31 without any spaces.

Next, ink supply to and ink discharge from the recording heads 10 will be explained.

Ink is supplied from the upstream sub-tank 15 via the tube 16*a* to the upstream ink port 10*b* and further to the recording heads 10 in response to an instruction from a control section which is not shown. Ink which is not discharged from the nozzles 10*a* is discharged from the downstream ink port 10*c*, and flows through the tube 16*b* thereby flowing out into the downstream sub-tank 11. Ink in the downstream sub-tank 11 is pumped up by the circulation pump 12 and returned to the upstream sub-tank 15 via the tube 16*c*. In the course of flowing through the tube 16*c*, temperature of ink is regulated by the temperature regulation section 13 to temperature suitable for forming an image, on the basis of a detection value of the upstream temperature sensor 41 or another temperature sensor provided separately on the ink supply path.

Furthermore, foreign substances in the ink are filtered out by the filter 14 during the ink circulation. The liquid level of the downstream sub-tank 11 is always maintained at an appropriate height by the liquid level regulation section 11*b*. As a liquid level regulation section 11*b*, for example, a float member which narrows outlet path to the tube 16*c* when the liquid level drops can be employed.

When the liquid level of the downstream sub-tank 11 drops while ink is being pumped up by the circulation pump 12 with a certain pressure, the float member being the liquid regulation section 11*b* descends and thereby narrowing the outlet path to the tube 16*c*. Channel resistance for the circulation pump 12 to pump up the ink from the downstream sub-tank 11 thus increases. As a result, an amount of ink to be pumped up from the downstream sub-tank 11 per unit of time decreases, and the ink liquid level of the downstream sub-tank 11 rises with ink flowing thereinto from the recording heads 10 side.

As explained above, the liquid level inside the downstream sub-tank 11 comes back to a certain height due to the effect of the liquid level regulation section 11*b*, even if the liquid level changes temporarily. As a result, when the ink is discharged from the nozzles 10*a* and the ink inside the upstream sub-tank 15 decreases, the liquid level of the ink inside the upstream sub-tank 15 drops. When the liquid level sensor 20*a* detects the drop of the liquid level inside the upstream sub-tank 15, the ink supply control section 20*c* opens the valve 20*b*. Then the ink is supplied from the ink bottle 19 to the upstream sub-tank 15 by way of the tube 18.

Since the ink is circulated via the recording heads 10, heat generated due to the drive of the recording heads 10 is propagated to the ink, thereby suppressing rise of the surrounding temperature of nozzles ejecting ink of the recording heads 10. How much the rise of surrounding temperature of nozzles ejecting ink of the recording heads 10 is suppressed is determined by amount and moving speed of the ink flowing through the recording heads 10 in addition to the above-mentioned temperature of ink flowing into the recording heads 10, if ink characteristics are not considered. At this time, the upstream temperature sensor 41 measures temperature of ink to be supplied to each of the recording heads 10, while the downstream temperature sensor 42 measures temperature of ink in the ink path, which is joined together with ink discharged from each of the recording heads.

Heat applied to the ink inside the recording heads is released in such a manner that the heat diffuses to the entire ink circulation path 2 due to movement of the ink inside the path. Therefore, temperature of the circulating ink does not rise easily. Furthermore, the circulation of the ink removes air bubbles and foreign substances getting stuck in the recording heads 10. With these actions, the image forming apparatus 1 is able to perform image forming operation without degrading quality of images to be formed (or printing quality), even if the apparatus 1 is operated for a long time.

Also, according to the present invention, a voltage for driving the recording heads 10 is corrected in response to an estimated temperature of ink being discharged from the nozzles 10*a*. The image quality is therefore not damaged, even if temperature of ink to be discharged changes depending on continuous operating time or printing rate of the recording heads.

Figure 3:
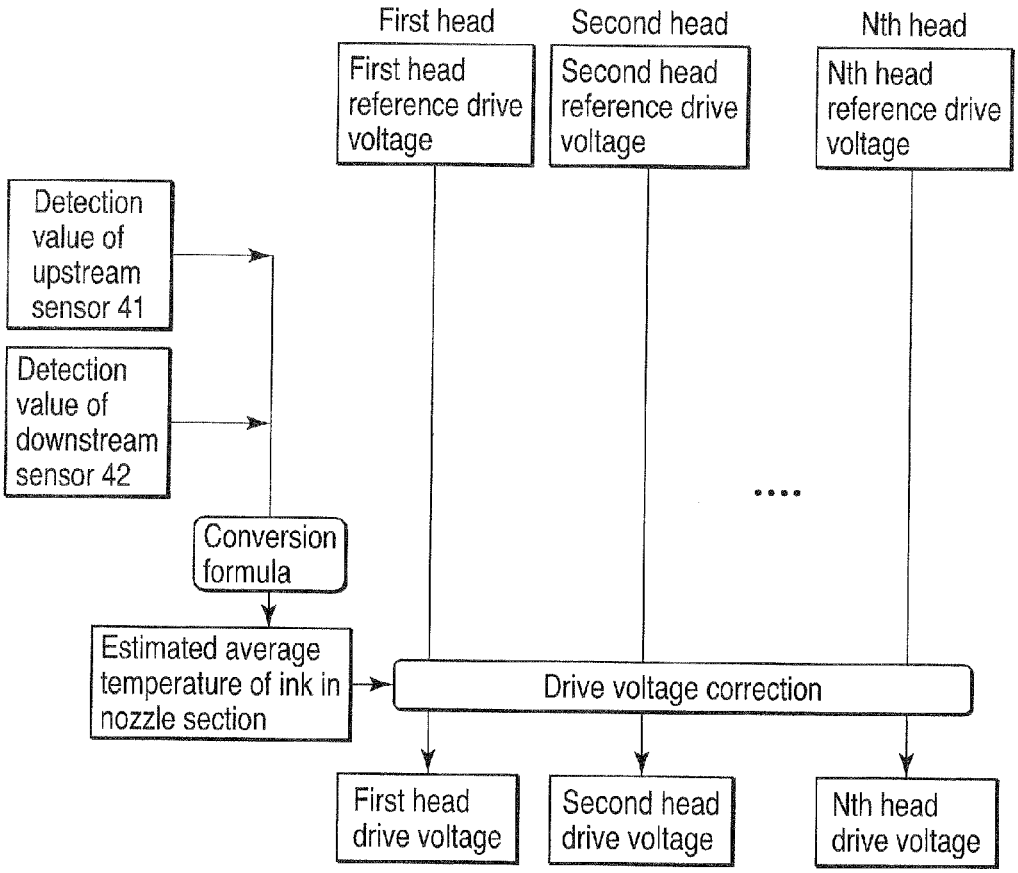
FIG. 3 is a diagram for explaining process for correcting a head drive voltage in response to changes in ink temperature in the first embodiment.

Next, a head drive control in the image forming apparatus according to the present embodiment will be explained with reference to FIGS. 1 and 3. FIG. 3 is a diagram for explaining process for correcting a head drive voltage in response to changes in ink temperature in the present embodiment.

The head drive control section 50 obtains detection values (information on ink temperatures) respectively detected by the upstream temperature sensor 41 and the downstream temperature sensor 42. The head drive control section 50 applies these detection values to the following conversion formula, and estimates an average surrounding temperature of nozzles ejecting ink in each of the head based on a calculation result. As a conversion formula (1) for obtaining an average is, for example:

$$\text{(average surrounding temperature of nozzles ejecting ink)}=\{\text{(temperature of ink upstream of head)}+\text{(temperature of ink downstream of head)}\}/2 \quad (1).$$

Figure 9:
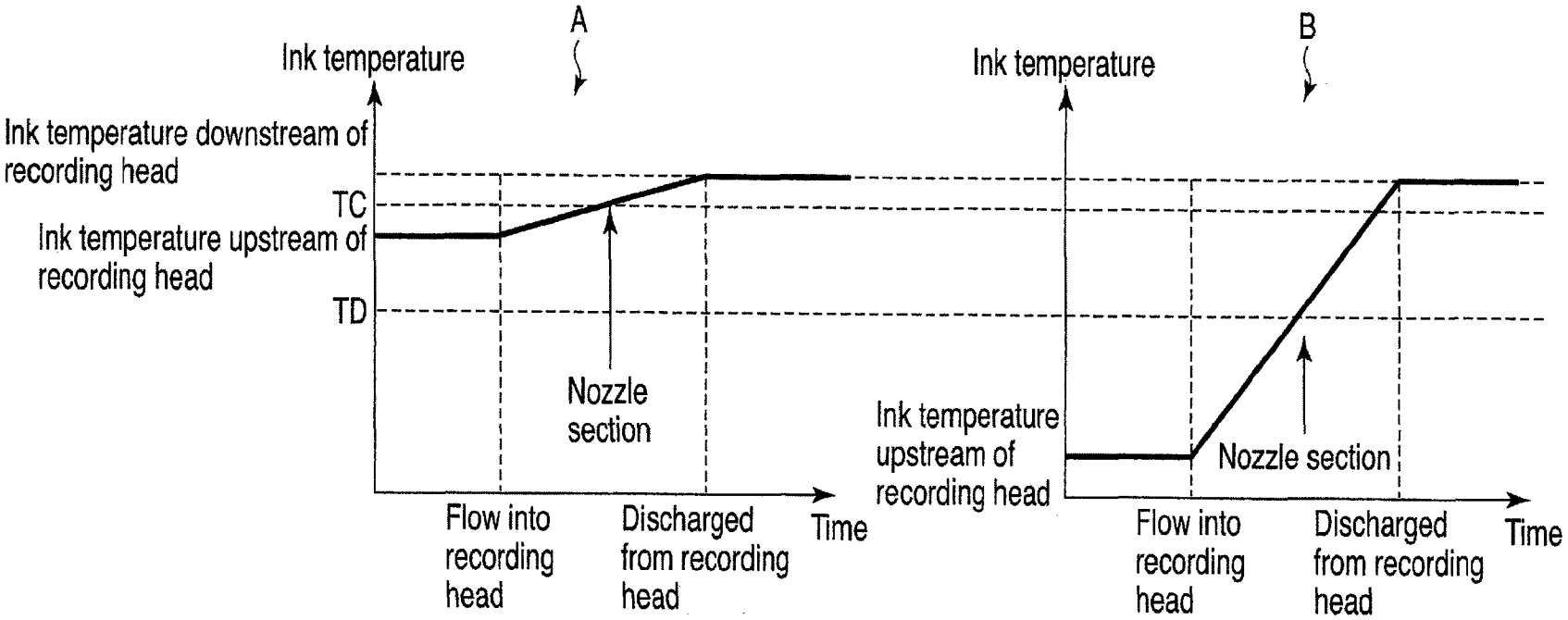
FIG. 9 PRIOR ART
FIG. 9 is a schematic diagram showing rises of ink temperature when ink flows into and out from a recording head in a conventional image forming apparatus.

When temperature of ink upstream of the head changes as explained in FIG. 9, the above conversion formula (1) enables to reflect an effect of the change in the estimated surrounding temperature of nozzles ejecting ink. Correction of the head drive voltage (temperature correction) is executed on the basis of the estimated average surrounding temperature of nozzles ejecting ink.

The correction executed here is, for example, a correction process in which a certain correction voltage is calculated based on a difference between a predetermined reference temperature and the estimated average surrounding temperature of nozzles ejecting ink, and the correction voltage is applied to a reference discharge voltage of each of the heads. The reference drive voltage here is a drive voltage inherent in driving each of the heads that is specified to make volumes of discharged drops even among the heads, for example, when ink of 35° C. is circulated and the heads are driven for a short time. The reference drive voltage is not limited to 35° C., and this temperature may be arbitrarily set in accordance with a design of an apparatus, an external environment, and ink characteristics, etc.

As described above, according to the present embodiment, an average surrounding temperature of nozzles ejecting ink is estimated and a drive voltage is corrected on as-needed basis. Therefore, even when surrounding temperature of nozzles ejecting ink of the recording heads 10 rises due to continuous operation, ink is discharged in a certain drop volume and the image quality is thereby maintained constant.

According to the present embodiment, an average surrounding temperature of nozzles ejecting ink is estimated on the basis of the two detection values respectively obtained with the upstream temperature sensor 41 and the downstream temperature sensor 42, and head drive voltages for all of the recording heads are collectively corrected by using the estimate value. However, the image forming apparatus of the present invention is not limited to the present embodiment. For example, after performing the above-described collective correction of head drive voltages with respect to all of the recording heads by using the estimated average surrounding temperature of nozzles ejecting ink, voltages for the recording heads may be individually corrected by using information on a printing amount such as a printing rate and a continuous operation time in each of the recording heads. Needless to say, the collective correction of head drive voltages and the individual correction of voltage for the recording head may be simultaneously performed in conjunction with each other.

Next, the second embodiment will be explained.

Figure 5:
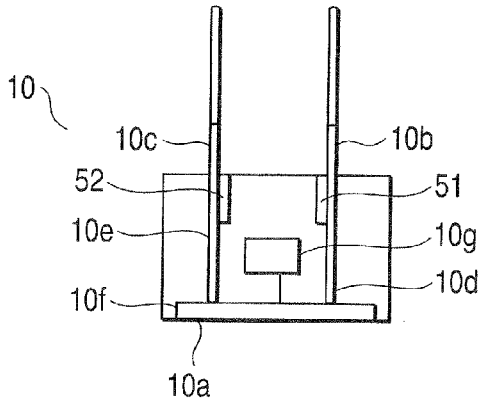
FIG. 5 is a schematic diagram for showing a configuration of a recording head of the second embodiment.
Figure 4:
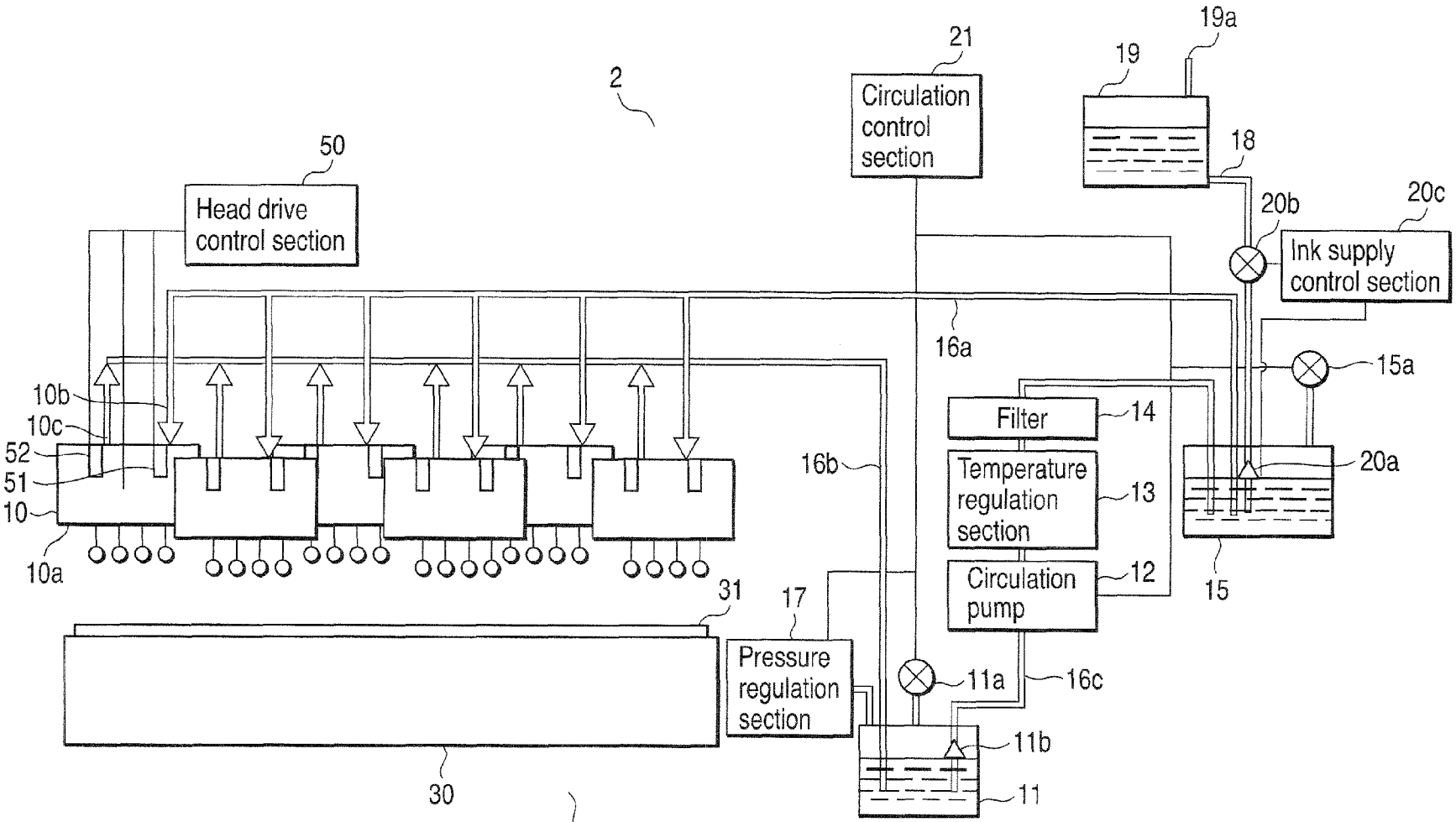
FIG. 4 is a schematic diagram for showing a configuration of an image forming apparatus according to a second embodiment.

FIG. 4 is a schematic diagram for showing a configuration of an image forming apparatus according to the second embodiment. FIG. 5 is a schematic diagram for showing a configuration of a recording head 10. With respect to components of the present embodiment, components equal to components shown in FIG. 1 are given the same referential symbols and their explanations are omitted. As in the above-explained FIG. 1, in FIGS. 4 and 5, an ink circulation path according to the gist of the present embodiment is shown in detail and other components are omitted. However, FIGS. 4 and 5 are provided on the presumption that the image forming apparatus according to the present embodiment includes components included in a standard image forming apparatus.

According to the above-explained first embodiment, head drive voltages of all of the recording heads are corrected collectively. In contrast, according to the present embodiment, temperature of ink upstream of the heads and temperature of ink downstream of the heads are detected, and head drive voltages of the respective recording heads are corrected individually.

In this image forming apparatus, an upstream temperature sensor 51 and a downstream temperature sensor 52 are respectively provided to the ink paths inside a recording head 10 in such a manner that the sensors respectively contact the ink paths, as shown in FIG. 5. A head drive control section 50 obtains detection values of the upstream temperature sensors 51 and the downstream temperature sensors 52, which are provided to the respective recording heads 10, and performs optimal correction of a head drive voltage with respect to each of the recording heads 10.

Figure 6:
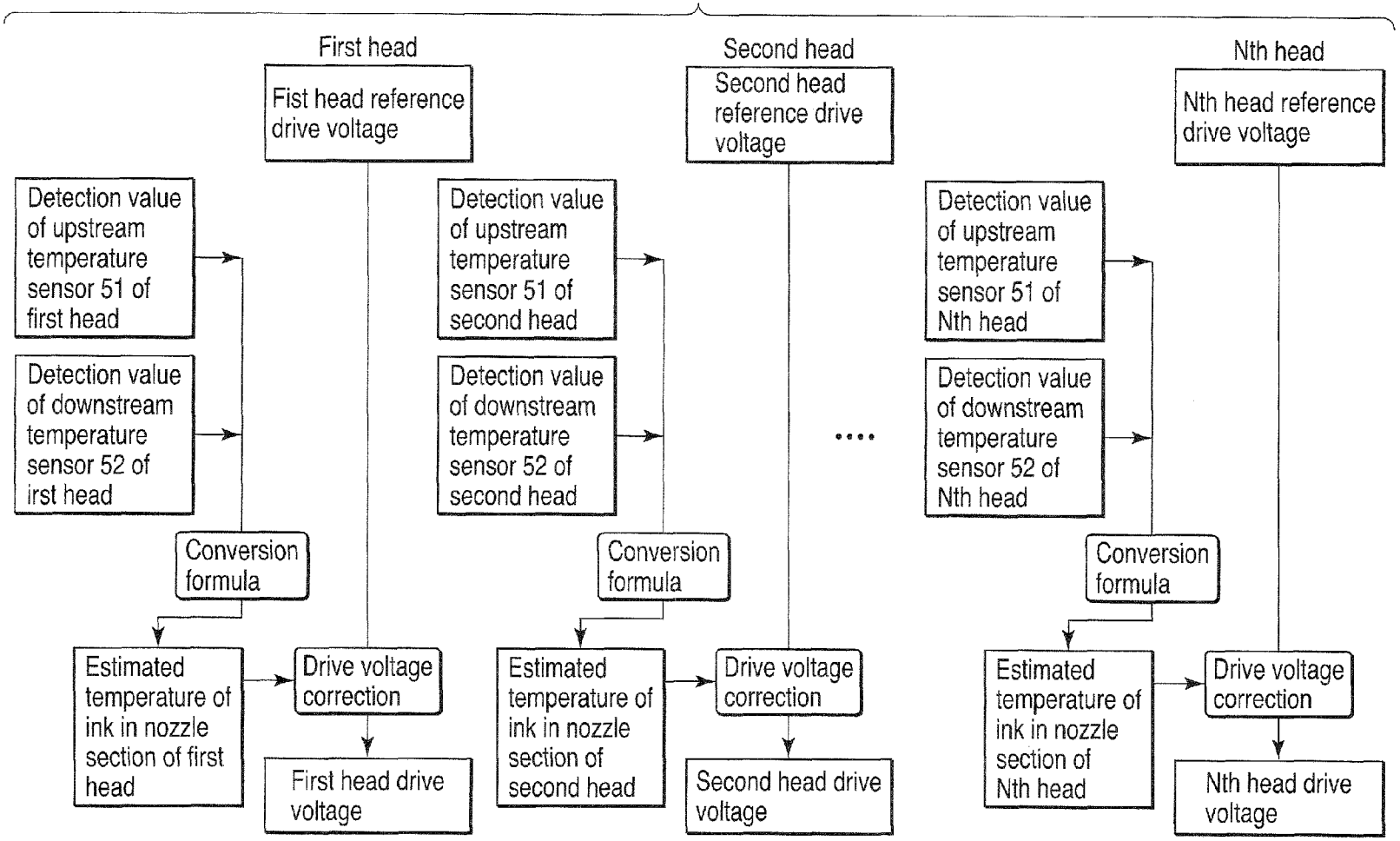
FIG. 6 is a diagram for explaining process for correcting a head drive voltage in response to changes in ink temperature in the second embodiment.

Next, a head drive control according to the present embodiment will be explained with reference to FIGS. 4 and 5. FIG. 6 is a diagram for explaining process for correcting a head drive voltage in response to changes in ink temperature. Here, correction of a head drive voltage will be explained by taking a drive control with respect to a first recording head 10 as a representative example.

The control section 50 obtains detection values (information on ink temperatures) detected by the two temperature sensors provided to the first recording head 10, and estimates ink temperature in a nozzle section of the first recording head 10 by plugging the obtained values in the above-described conversion formula (1).

Then, the control section 50 executes correction of a drive voltage of the first recording head 10 on the basis of the detected ink temperature in the nozzle section of the first recording head 10. The voltage correction performed in this embodiment is equal to the correction of the head drive voltage disclosed in the first embodiment. The control section 50 executes control of head drive voltages with respect to all of the recording heads 10 in the similar manner. According to the head drive control of the present embodiment, printing rates differ among the recording heads 10. Therefore, an appropriate correction of a drive voltage is able to be performed even when ink temperatures in the nozzles sections of the recording heads differ from one another. With this configuration, each of the recording heads 10 is prevented from being influenced by temperature changes in the respective recording heads 10 and is able to continue ejecting ink in a certain drop volume, thereby preventing degradation of the printing quality.

According to the present embodiment, an upstream temperature sensor 51 is provided inside a recording head 10. However, a configuration is not limited to the present embodiment. For instance, an installation place of an upstream temperature sensor 51 is not limited, as long as it is arranged upstream of a recording head 10 with respect to the ink supply path in such a manner that temperature of ink flowing into the recording head 10 does not differ greatly from ink temperature detected by the upstream temperature sensor 51. The upstream temperature sensor 51 may be provided, for example, inside the upstream sub-tank 15 as long as the above condition is satisfied. Similarly, an installation place of a downstream temperature sensor 52 is not limited, as long as it is arranged downstream of a recording head 10 with respect to the ink supply path in such a manner that temperature of ink flowing out from the recording head 10 does not differ greatly from ink temperature detected by the downstream temperature sensor 52. The downstream temperature sensor 52 may be provided, for example, inside the downstream sub-tank 11 as long as the above condition is satisfied.

The present embodiment is not limited to the image forming apparatus employing the recording head including a temperature sensor therein. For example, even in a case where a recording head which does not include a temperature sensor is employed, the present embodiment is applicable and a similar advantage can be obtained therefrom by adding on temperature sensors respectively upstream and downstream of the recording head with respect to the Ink supply path.

Next the third embodiment will be explained.

A configuration of an image forming apparatus according to the present embodiment is applicable to the apparatus configurations explained in the first and second embodiments. With respect to components of the present embodiment, components equal to the components shown in FIG. 1 are given the same referential symbols and their explanations are omitted. As in the first and second embodiments, in the present embodiment too, it is assumed that an apparatus according to the present embodiment includes components included in a standard image forming apparatus.

The present embodiment differ from the first and second embodiments in the concept of a conversion formula wherein an average temperature of ink in a nozzle section is calculated on the basis of ink temperatures respectively detected upstream and downstream of recording heads in an ink circulation path.

In the following conversion formula (1),

[Formula 1]

$$T_N \approx \frac{T_1 + T_4}{2} + \frac{1}{4}\frac{w_2\alpha_2}{C}(T_4 - T_1)\frac{1}{U_c} \quad (1)$$

$T_n$ is surrounding temperature of nozzles ejecting ink, and $w_2\alpha_2$ is a constant indicating efficiency of heat transferred from the ejecting element to the ink. These are inherent to a configuration of the head. Also, C is specific heat constant of the ink, and $U_c$ is ink flow speed in the vicinity of the nozzle (ejecting element).

In this conversion formula (1), a value, which is obtained by adding a correction value calculated from the upstream and downstream ink temperatures to an average value of temperatures of ink upstream and downstream of the recording head 10, is considered as surrounding temperature of nozzles ejecting ink.

Figure 7:
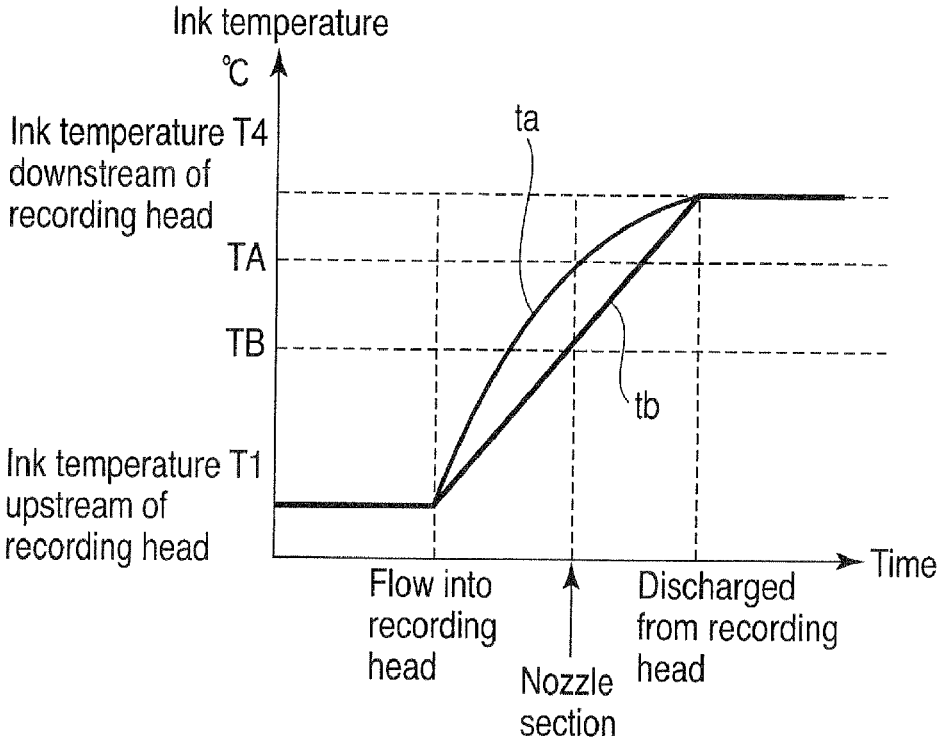
FIG. 7 is a schematic diagram showing rises of ink temperature when ink flows into and out from a recording head in a third embodiment.

FIG. 7 is a schematic diagram showing rises of ink temperature when ink flows into and out from the recording head 10. When temperature of the nozzle of the recording head 10 is constant, amount of heat propagated to ink, which is in contact with the nozzle, per unit of time is proportional to a temperature difference between the ink and the nozzle. That is to say, the amount of heat propagated to the ink in a unit of time decreases as the ink temperature rises, and rising speed of ink temperature therefore decreases. Thus, rise of temperature of ink flowing in the head does not represent a rectilinear temperature rising line (tb) showing constant rise of temperature. Instead, temperature of the ink flowing in the head represents a temperature rising curve (ta) in which rising is fast and gradually saturated as shown in FIG. 7. When it is assumed that surrounding temperature of nozzles ejecting ink in the above case is TA° C. and that estimated surrounding temperature of nozzles ejecting ink in a case where temperature rises at a constant speed is TB° C., there is generated a temperature difference as shown in FIG. 7. Surrounding temperature of nozzles ejecting ink TA° C. turns out to be higher than an average temperature of ink TB° C. upstream of the head and downstream of the head.

In the conversion formula according to the above-explained first and second embodiments (refer to FIG. 9), it is assumed that temperature of ink rises at a constant speed. It is possible to intuitively understand from FIG. 7 that an estimated value of temperature of the nozzle section obtained by using the conversion formula (2) is closer to true value than that obtained by using the conversion formula according to the first and second embodiments.

Next, a reason why ink temperature in the nozzle section is estimated with the conversion formula (2) will be explained.

Figure 8:
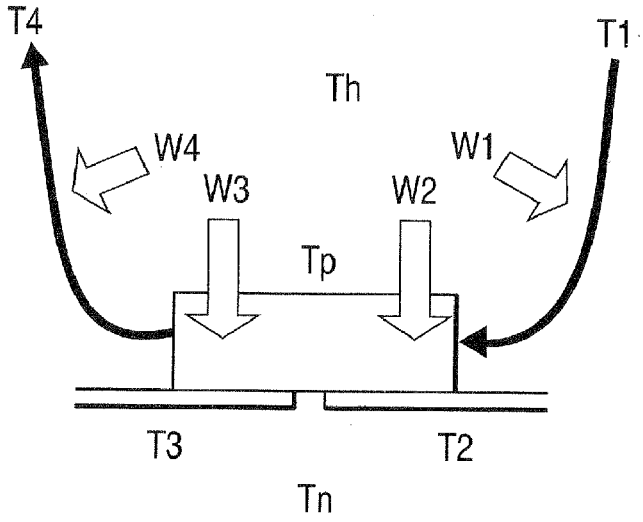
FIG. 8 is a schematic diagram for explaining flow of ink flowing into and out from the recording head and transfer of heat in the third embodiment.

FIG. 8 is a schematic diagram for explaining flow of ink (black arrow) flowing into and out from the recording head 10 in the ink circulation path 2 and flow of heat (outline arrow) transferred into the ink.

In FIG. 8, reference symbols are defined as follows: T1 is temperature of ink [° C.] flowing from the ink supply path into the recording head 10 detected by the upstream temperature sensor 41; T2 is temperature of ink [° C.] at a border of an entrance side of the ejecting element in the path inside the recording head 10; T3 is temperature of ink [° C.] at a border of an exit side of the ejecting element in the path inside the recording head 10; T4 is temperature of ink [° C.] discharged from the recording head 10 to the ink discharge path detected by the downstream temperature sensor 42; Th is a temperature inside the recording head; W1-W4 are amount of heat transferred to ink [J]; Tp is temperature of the ejecting element [° C.]; and Ua is flow speed of ink in the ink circulation path [mm/s].

First of all, flow of ink inside the recording head 10 is divided into four: flow inside the upstream ink path 10*d* (S1); flow in the upstream side of the nozzle 10*a* which is close to the ejecting element 10*f* (S2); flow in the downstream side of the nozzle 10*a* which is close to the ejecting element 10*f* (S3); and flow inside the downstream ink path 10*e* (S4).

As is described above, temperatures of ink respectively detected by the upstream temperature sensor 41 and the downstream temperature sensor 42 are respectively considered as temperature of ink flowing into the recording head 10 and temperature of ink discharged from the recording head 10. In other words, in the route between the upstream temperature sensor 41 and the downstream temperature sensor 42, heat is transferred into the ink (mainly, heated) only inside the recording head. Therefore, FIG. 8 shows a model in which only the inside of the recording head is considered. It is assumed that ink flow speed in the upstream ink path 10*d* and that in the downstream ink path 10*e* are the same, namely, Ua [mm/s]. Also, it is assumed that ink flow speed inside the ejecting element is Uc [mm/s]. Furthermore, it is assumed that temperature inside the head is Th [° C.] and temperature of the ejecting element is Tp [° C.]

Th and Tp are parameters that change in accordance with printing rate and continuous printing time of the recording head 10. Here, surrounding temperature of nozzles ejecting ink to be obtained is represented by Tn [° C.]. Amount of heat transferred (propagated) between two contacting substances is proportional to a temperature difference between the two, heat transfer efficiency between the two, and time spent for heat transfer. Temperature T [° C.] of a substance which received amount of heat W [J] can be expressed as T=T0+W/C, by using initial temperature T0 [° C.] of the substance. C represents specific heat of the substance.

When amount of transferred heat and ink temperature in each of the four divided parts are considered in FIG. 8, the following formula can be provided. Heat transfer in the upstream ink path and temperature T2 are respectively represented with formulae (2-1) and (2-2) as follows:

[Formula 2]

$$T_2 = T_1 + W_1 / C \tag{2-1}$$

$$W_1 = w_1\left(T_H - \frac{T_1 + T_2}{2}\right) \Big/ U_a \times \alpha_1 \tag{2-2}$$

Also, heat transfer upstream of a neighborhood nozzle and temperature Tn are respectively represented with formulae (3-1) and (3-2) as follows:

[Formula 3]

$$T_N = T_2 + W_2 / C \tag{3-1}$$

$$W_2 = w_2\left(T_P - \frac{T_2 + T_N}{2}\right) \Big/ U_c \times \alpha_2 \tag{3-2}$$

Heat transfer downstream of a nozzle close to a ejecting element and temperature T3 are respectively represented with formulae (4-1) and (4-2) as follows:

[Formula 4]

$$T_3 = T_N + W_3 / C \tag{4-1}$$

$$W_3 = w_2\left(T_P - \frac{T_N + T_3}{2}\right) \Big/ U_c \times \alpha_2 \tag{4-2}$$

Furthermore, heat transfer downstream of the ink path and temperature T4 are respectively represented with formulae (5-1) and (5-2) as follows:

[Formula 5]

$$T_4 = T_3 + W_4 / C \tag{5-1}$$

$$W_4 = w_1\left(T_H - \frac{T_3 + T_4}{2}\right) \Big/ U_a \times \alpha_1 \tag{5-2}$$

Here, C is a constant representing specific heat of the ink. Also, $\alpha_1$ and $\alpha_2$ are proportional constants for performing conversion of ink flow speed and time, and both of them are greater than 0. $w_1$ and w are proportional constants inherent to the head for representing heat transfer efficiencies between ink and the inside of the recording head or between ink and the ejecting element, and both of them are greater than 0. In the following formula, A and B are specified as shown in the next formula (6), for simplifying a definition.

[Formula 6]

$$A = \frac{w_1 \alpha_1}{U_a C} \qquad B = \frac{w_2 \alpha_2}{U_c C} \tag{6}$$

Next, the following formula (2-3) is derived from the formulae (2-1) and (2-2).

[Formula 7]

$$T_2 = T_1 + \frac{w_1 \alpha_1}{U_a C}\left(T_H - \frac{T_1 + T_2}{2}\right) \tag{2-4}$$

$$\left(1 + \frac{1}{2}A\right)T_2 = \left(1 - \frac{1}{2}A\right)T_1 + AT_H$$

$$T_2 = \left\{\left(1 - \frac{1}{2}A\right)T_1 + AT_H\right\} \Big/ \left(1 + \frac{1}{2}A\right) \tag{2-3}$$

Next, the following formula (3-3) is derived from the formulae (3-1) and (3-2).

[Formula 8]

$$T_N = T_2 + \frac{w_2 \alpha_2}{U_c C}\left(T_P - \frac{T_2 + T_N}{2}\right) \tag{3-3}$$

$$\left(1 + \frac{1}{2}B\right)T_N = BT_P + \left(1 - \frac{1}{2}B\right)T_2$$

$$T_N = \left\{\left(1 - \frac{1}{2}B\right)T_2 + BT_P\right\} \Big/ \left(1 + \frac{1}{2}B\right)$$

Furthermore, the following formula (4-3) is derived from the formulae (4-1) and (4-2).

[Formula 9]

$$T_3 = T_N + \frac{w_2\alpha_2}{U_c C}\left(T_P - \frac{T_N + T_3}{2}\right) \quad (4\text{-}3)$$

$$(T_3 - T_N)/B = T_P - \frac{T_N + T_3}{2}$$

$$T_P = \left(\frac{1}{2} - \frac{1}{B}\right)T_N + \left(\frac{1}{2} + \frac{1}{B}\right)T_3$$

Furthermore, the following formula (5-3) is derived from the formulae (5-1) and (5-2).

[Formula 10]

$$T_4 = T_3 + \frac{w_1\alpha_1}{U_a C}\left(T_H - \frac{T_3 + T_4}{2}\right) \quad (5\text{-}3)$$

$$\left(1 - \frac{1}{2}A\right)T_3 = \left(1 + \frac{1}{2}A\right)T_4 - AT_H$$

$$T_3 = \left\{\left(1 + \frac{1}{2}A\right)T_4 - AT_H\right\} \Big/ \left(1 - \frac{1}{2}A\right)$$

A used in the above formula is a number representing heat transfer efficiency between ink upstream of the ink supply path and downstream of the ink discharge path, and the inside of the recording head 10. Also, B is a number for representing heat transfer efficiency between the ejecting element and the ink. The both A and B are equal to or more than 0 and equal to or less than 1. A reason for this will be explained by taking the formula (2-4) indicating rise of temperature of ink in the ink supply path as an example.

When ink flows into the ink supply path, ink temperature T2 in the final state is definitely T2<Th. Therefore, the following formula (7) is derived from the formula (2-4).

[Formula 11]

$$T_2 = T_1 + A\left(T_H - \frac{T_1 + T_2}{2}\right) < T_H \quad (7)$$

$$A\left(T_H - \frac{T_1 + T_2}{2}\right) < T_H - T_1$$

$$A < \frac{T_H - T_1}{T_H - \frac{T_1 + T_2}{2}}$$

$$= \left(1 - \frac{T_1}{T_H}\right) \Big/ \left(1 - \frac{\frac{T_1}{T_H} + \frac{T_2}{T_H}}{2}\right)$$

$$= \left(1 - \frac{T_1}{T_H}\right) \Big/ \left(1 - \frac{1}{T_H}\frac{T_1 + T_2}{2}\right)$$

Since heating of ink inside the recording head 10 is considered, T2>T1, and it is derived from the above formula that A<1. Similarly, a parameter B representing heat transfer efficiency between the ejecting element and the ink is B<1. Then, unknown parameters are deleted from the formula (2-3), (3-3), (4-3), and (5-3). The following formula (8) is derived from the formulae (3-3) and (4-3).

[Formula 12]

$$\left(1 + \frac{1}{2}B\right)T_N = \left\{\left(1 - \frac{1}{2}B\right)T_2 + B\left(\frac{1}{2} - \frac{1}{B}\right)T_N + B\left(\frac{1}{2} + \frac{1}{B}\right)T_3\right\} \quad (8)$$

$$2T_N = \left(1 - \frac{1}{2}B\right)T_2 + \left(1 + \frac{1}{2}B\right)T_3$$

Furthermore, the following formula (9) is derived from the formulae (2-3) and (5-3) as follows:

[Formula 13]

$$2T_N = \frac{\left(1 - \frac{1}{2}B\right)}{\left(1 + \frac{1}{2}A\right)}\left\{\left(1 - \frac{1}{2}A\right)T_1 + AT_H\right\} + \frac{\left(1 + \frac{1}{2}B\right)}{\left(1 - \frac{1}{2}A\right)}\left\{\left(1 + \frac{1}{2}A\right)T_4 - AT_H\right\} \quad (9)$$

$$= \frac{2 - A}{2 + A}\left(1 - \frac{1}{2}B\right)T_1 + \frac{2 + A}{2 - A}\left(1 + \frac{1}{2}B\right)T_4 + \left(\frac{2 - B}{2 + A} - \frac{2 + B}{2 - A}\right)AT_H$$

$$= \frac{2 - A}{2 + A}\left(1 - \frac{1}{2}B\right)T_1 + \frac{2 + A}{2 - A}\left(1 + \frac{1}{2}B\right)T_4 + \left(\frac{1 - \frac{1}{2}B}{1 + \frac{1}{2}A} - \frac{1 + \frac{1}{2}B}{1 - \frac{1}{2}A}\right)AT_H$$

Transfer of heat into the ink that is generated inside the recording head 10 occurs mainly in the ejecting element. This is because the ejecting element is in direct contact with the ink, and because heat generation in the ejecting element is large. This fact does not change even if the ejecting element is a piezoelectric element or a heater. Therefore, in the formula (10), it is assumed that effect of temperature inside the recording head is small and a term of Th is ignored.

Furthermore, as mentioned above, the ejecting element is in direct contact with the ink, and heat transfer efficiency B between the ejecting element and the ink is greater than heat transfer efficiency A between the recording head 10 and the ink. Therefore, the following formula (10) can be obtained when A/B≈0 as follows:

[Formula 14]

$$2T_N \approx \left(1 - \frac{1}{2}B\right)T_1 + \left(1 + \frac{1}{2}B\right)T_4 \quad (10)$$

$$T_N \approx \frac{T_1 + T_4}{2} + \frac{1}{4}B(T_4 - T_1)$$

$$T_N \approx \frac{T_1 + T_4}{2} + \frac{1}{4}\frac{w_2\alpha_2}{C}(T_4 - T_1)\frac{1}{U_c}$$

Since ink is heated by going through the recording head, T4>T1. Therefore, according to the above formula (10), ink temperature in the nozzle section is a value obtained by adding a term of a numerical value derived from a temperature difference between the upstream side and the downstream side of the recording head (T4−T1) to a term of an average of T1 representing ink temperature upstream of the recording head 10 and T4 representing ink temperature downstream of the recording head 10.

Also, since B<1 as mentioned above, it can be known that temperature Tn of ink in the nozzle section does not exceed ink temperature T4. $U_c$ represents ink flow speed in the vicinity of the ejecting element, and it is a value obtained by multiplying ink flow speed Ua on the upstream side of the ink path by a constant. The ink flow speed Ua is determined by ink flow volume flowing through the ink circulation path. This flow volume is inversely proportional to loss of pressure generated during ink circulation in the entire ink circulation path. This loss of pressure is proportional to ink viscosity in the ink circulation path. Ink viscosity can be expressed as a function of ink temperature.

Therefore, the ink flow speed Ua can be expressed with ink temperature in the ink circulation path. Ink temperature in the ink circulation path can be obtained, for example, with the upstream temperature sensor 41. Therefore, the ink flow speed $U_c$ can be expressed as a function of T1. Furthermore, a value of $w_2\alpha_2$ is a constant inherent to a configuration of the head, and It can be preliminarly measured. Consequently, ink temperature in the nozzle section can be expressed with the formula (10) by using temperature T1 of ink upstream of the head and temperature T4 of ink downstream of the head.

As explained above, according to the third embodiment, ink temperature in the nozzle section can be estimated with high accuracy by using temperatures of ink supplied to and discharged from the recording head. It is possible to correct head drive voltage with high accuracy on the basis of the estimated ink temperature in the nozzle section, in order to compensate for changes in ink characteristics (viscosity) caused by temperature changes arising from heating of components. Consequently, deterioration of quality of image to be formed can be prevented.

Therefore, even when recording head is operated for a long time (that is to say, ink ejecting time is long) to cause temperature changes in the ink, it is possible to keep graphic quality of an image to be formed equal to that of an image formed under a normal operation.

Furthermore, in the present embodiment, an example wherein one recording head 10 is provided between the upstream temperature sensor 41 and the downstream temperature sensor 42. However, the present embodiment is not limited to the above. For example, the calculation of estimation according to the present embodiment can be applied to the first embodiment. With this application, an average ink temperature of the nozzle sections of the plurality of recording heads can be obtained with high accuracy.

Also, in the first to third embodiments, an image forming apparatus is not limited to one employing a line recording method having a plurality of line recording heads. For example, an image forming apparatus may employ a serial recording method in which an image is formed by scanningly moving a single recording head in a width direction of a recording media. Needless to say, components may be appropriately combined for putting into practice in each of the above embodiments. Also, it is possible to put the present invention into practice even if components that are considered unnecessary, excluding the upstream temperature sensor 41 and the downstream temperature sensor 42, are deleted.

Furthermore, in the image forming apparatus according to the first to third embodiments, fluid is ink flowing through the ink circulation path (ink supply path and ink discharge path). However, in the present invention, fluid is not limited to ink.

For example, in a case of an image forming apparatus wherein a cooling fluid path for flowing cooling fluid which cools a heated recording head (this cooling fluid path comprises a cooling fluid supply path and a cooling fluid discharge path, both of which are connected to the recording head) is connected to the recording head, the cooling fluid flowing through the cooling fluid supply path and the cooling fluid discharge path may be used as a fluid. In other words, it becomes possible to appropriately set a head drive voltage in the similar manner as the above embodiments, by detecting temperature of cooling fluid flowing into the recording head and temperature of cooling fluid discharged from the recording head.

According to the present invention, it is possible to provide an image forming apparatus capable of keeping graphic quality constant even under a continuous operation, by detecting temperature of fluid flowing into a recording head and temperature of fluid discharged from the recording head for estimating ink temperature in a nozzle section and performing an appropriate correction for a head drive voltage.

What is claimed is:

1. An image forming apparatus comprising:

a recording head in which a plurality of nozzles for ejecting ink are formed;

a supply path which supplies fluid to the recording head;

a discharge path which ejects the fluid from the recording head;

a first thermistor arranged on the supply path side;

a second thermistor arranged on the discharge path side; and a control section which sets an ink ejecting drive voltage for the recording head on the basis of an output from the first thermistor and an output from the second thermistor;

wherein:

the recording head includes a plurality of ink ejecting heads, the supply path comprises a common supply part and divergent supply parts diverged from the common supply part for supplying the fluid to each of the plurality of ink ejecting heads, the discharge path comprises a common discharge part and divergent discharge parts diverged from the common discharge part for ejecting the fluid from each of the plurality of ink ejecting heads, the first thermistor is arranged in the common supply part, and the second thermistor is arranged in the common discharge part.

2. The image forming apparatus according to claim 1, wherein the fluid comprises ink discharged from the nozzles.

3. The image forming apparatus according to claim 1, wherein the fluid comprises cooling fluid for cooling the recording head.

4. An image forming apparatus comprising:

a recording head in which a plurality of nozzles for ejecting ink are formed;

a supply path which supplies fluid to the recording head;

a discharge path which ejects the fluid from the recording head;

a first thermistor arranged on the supply path side;

a second thermistor arranged on the discharge path side; and a control section which sets an ink ejecting drive voltage for the recording head on the basis of an output from the first thermistor and an output from the second thermistor;

wherein:

the recording head comprises a plurality of recording heads, the supply path and the discharge path are formed inside each of the plurality of recording heads, the first thermistor includes a plurality of thermistors respectively provided to the supply paths inside the respective plurality of recording heads, and the second thermistor includes a plurality of thermistors respectively provided to the discharge paths inside the respective plurality of recording heads.

5. The image forming apparatus according to claim 4, wherein the control section calculates a surrounding temperature of nozzles ejecting ink of the recording head from an average temperature value of an output from the first thermistor and an output from the second thermistor.

6. The image forming apparatus according to claim 4, wherein the control section calculates a surrounding temperature of nozzles for the respective heads and sets ink ejecting drive voltages to the respective recording heads.

7. The image forming apparatus according to claim 4, further comprising a return path connecting the supply path and the discharge path for returning the fluid discharged to the discharge path to the supply path, thereby constructing a circulation path, wherein the return path is provided with a pump for forcing the fluid to the supply path and a temperature regulation section for regulating a temperature of the fluid.

8. The image forming apparatus according to claim 4, wherein the fluid comprises ink discharged from the nozzles.

9. The image forming apparatus according to claim 4, wherein the fluid comprises cooling fluid for cooling the recording head.

10. An image forming apparatus comprising:

a recording head in which a plurality of nozzles for ejecting ink are formed;

a supply path which supplies fluid to the recording head;

a discharge path which ejects the fluid from the recording head;

a first thermistor arranged on the supply path side;

a second thermistor arranged on the discharge path side; and a control section which sets an ink ejecting drive voltage for the recording head on the basis of an output from the first thermistor and an output from the second thermistor;

wherein:

the recording head includes a plurality of ink ejecting heads, the supply path comprises a common supply part and divergent supply parts diverged from the common supply part for supplying the fluid to each of the plurality of ink ejecting heads, the discharge path comprises a common discharge part and divergent discharge parts diverged from the common discharge part for ejecting the fluid from each of the plurality of ink ejecting heads, the first thermistor is arranged in the divergent supply parts, and the second thermistor is arranged in the divergent discharge parts.

* * * * *